US009103157B2

(12) United States Patent
Mullet et al.

(10) Patent No.: US 9,103,157 B2
(45) Date of Patent: Aug. 11, 2015

(54) SPRING COUNTERBALANCE APPARATUS AND METHOD

(71) Applicant: QMOTION INCORPORATED, Pensacola, FL (US)

(72) Inventors: Willis Jay Mullet, Gulf Breeze, FL (US); Richard Scott Hand, Pace, FL (US); Lucas Hunter Oakley, Pensacola Beach, FL (US)

(73) Assignee: QMOTION INCORPORATED, Pensacola, FL (US)

( * ) Notice: Subject to any disclaimer, the term of this patent is extended or adjusted under 35 U.S.C. 154(b) by 105 days.

(21) Appl. No.: 13/986,207

(22) Filed: Apr. 13, 2013

(65) Prior Publication Data

US 2014/0305601 A1 Oct. 16, 2014

(51) Int. Cl.

| | |
|---|---|
| ***A47H 5/00*** | (2006.01) |
| ***E06B 9/322*** | (2006.01) |
| ***E06B 9/262*** | (2006.01) |
| *E06B 9/56* | (2006.01) |

(52) U.S. Cl.

CPC ..... *E06B 9/322* (2013.01); *E06B 9/262* (2013.01); *E06B 9/56* (2013.01); *E06B 2009/2627* (2013.01); *E06B 2009/3222* (2013.01)

(58) Field of Classification Search

CPC ..... E06B 9/322; E06B 9/62; E06B 9/56; E06B 9/60

USPC ..... 160/168.1 R, 173 R, 170, 192, 178.1 R, 160/190, 191, 189, 313, 315, 317, 318, 160/84.01, 84.04, 84.02

See application file for complete search history.

(56) References Cited

U.S. PATENT DOCUMENTS

| | | | | |
|---|---|---|---|---|
| 3,291,474 | A * | 12/1966 | Clarke | 267/156 |
| 5,590,741 | A * | 1/1997 | Storms | 185/10 |
| 6,012,506 | A * | 1/2000 | Wang et al. | 160/170 |
| 6,056,036 | A * | 5/2000 | Todd et al. | 160/84.05 |
| 6,129,131 | A * | 10/2000 | Colson | 160/84.02 |
| 6,234,236 | B1 * | 5/2001 | Kuhar | 160/170 |
| 6,283,192 | B1 | 9/2001 | Toti | |
| 6,474,394 | B2 * | 11/2002 | Kuhar | 160/170 |
| 6,536,503 | B1 | 3/2003 | Anderson et al. | |
| 6,601,635 | B2 * | 8/2003 | Ciuca et al. | 160/170 |
| 6,644,372 | B2 * | 11/2003 | Judkins | 160/84.04 |
| 6,648,050 | B1 | 11/2003 | Toti | |
| 6,761,203 | B1 * | 7/2004 | Huang | 160/170 |
| 6,957,683 | B2 | 10/2005 | Toti | |
| 6,983,783 | B2 | 1/2006 | Carmen, Jr. et al. | |
| 7,185,691 | B2 | 3/2007 | Toti | |
| 7,228,797 | B1 * | 6/2007 | Hillman et al. | 100/170 |
| 7,311,133 | B2 * | 12/2007 | Anderson et al. | 160/170 |
| 7,341,091 | B2 * | 3/2008 | Nien et al. | 160/170 |
| 7,717,156 | B2 * | 5/2010 | Costello et al. | 160/317 |
| 7,740,045 | B2 * | 6/2010 | Anderson et al. | 160/84.05 |
| 8,251,119 | B2 * | 8/2012 | Toti et al. | 160/168.1 R |

(Continued)

*Primary Examiner* — Katherine Mitchell
*Assistant Examiner* — Johnnie A Shablack
(74) *Attorney, Agent, or Firm* — Zarley Law Firm, P.L.C.

(57) ABSTRACT

A spring counterbalance apparatus and method consists of a shade system with a torque profile, where the shade system is connected with a drive shaft. A first spring system is connected with the drive shaft where the first spring system is a standard wound spring system. A second spring system is connected with the drive shaft where the second spring system is a reverse wound spring system and where, in combination, the first spring system and the second spring system produce a counterbalance torque profile approximately equal to the shade system torque profile.

25 Claims, 8 Drawing Sheets

(56) References Cited

U.S. PATENT DOCUMENTS

| | | | | |
|---|---|---|---|---|
| 8,307,879 | B2 * | 11/2012 | Lin | 160/314 |
| 8,567,476 | B2 * | 10/2013 | Costello et al. | 160/317 |
| 8,573,281 | B2 * | 11/2013 | Drew et al. | 160/84.05 |
| 8,708,024 | B2 * | 4/2014 | Toti | 160/170 |
| 2002/0157796 | A1 | 10/2002 | Judkins | |
| 2004/0177933 | A1 * | 9/2004 | Hillman et al. | 160/170 |
| 2007/0193703 | A1 * | 8/2007 | Cheng | 160/173 R |
| 2010/0024994 | A1 * | 2/2010 | Lin | 160/343 |
| 2011/0277943 | A1 * | 11/2011 | Lin | 160/84.04 |
| 2012/0061037 | A1 * | 3/2012 | Chen | 160/315 |
| 2012/0061502 | A1 * | 3/2012 | Chen | 242/372 |
| 2013/0087415 | A1 * | 4/2013 | Hsieh | 185/37 |
| 2013/0248125 | A1 * | 9/2013 | Lin, Tzong-Fu | 160/84.05 |
| 2014/0157547 | A1 * | 6/2014 | Chen | 16/400 |

* cited by examiner

SPRING COUNTERBALANCE APPARATUS AND METHOD

FIELD OF THE INVENTION

This invention relates to a spring counterbalance apparatus and method. In particular, in accordance with one embodiment, the invention relates to a spring counterbalance apparatus consisting of a shade system with a torque profile, where the shade system is connected with a drive shaft. A first spring system is connected with the drive shaft where the first spring system is a standard wound spring system. A second spring system is connected with the drive shaft where the second spring system is a reverse wound spring system and where, in combination, the first spring system and the second spring system produce a counterbalance torque profile approximately equal to the shade system torque profile.

BACKGROUND OF THE INVENTION

A problem exists in the field of architectural opening covers, shade systems, with regard to the raising and lowering of the cover and associated elements such as lift cords and bottom bars, as are known in the art. Prior art solutions include motor driven systems connected to outside power sources. These systems are powerful enough to simply muscle a cover up and down no matter what the weight of the system and despite the high torque requirements to be overcome. These systems are usually bulky, noisy and expensive. Further, despite the advantages the un-counterbalanced weight of the shade system eventually will wear out these systems and lead to expensive replacement options.

For each particular shade system, a certain amount of torque must be applied to raise and lower a shade. Thus, each shade system has a particular "shade system torque profile". With powered systems, the prior art solution, again, is simply to apply more than enough power to overcome the torque requirements. Shades and blinds such as cellular shades and Venetian blinds always have approximately the same suspended weight whether the blind is in the open or closed position. This differentiates their counterbalancing requirements from roll shades which lose weight as the shade is reeled onto the storage roll. In both cases the drive shaft or storage roll must rotate to adjust the shade over the opening and the effects on the counterbalances are different.

Counterbalanced systems are known in the art that attempt to offset at least partially the heavy weight and torque requirements of a shade system so that quieter, less expensive battery powered systems are possible. Most of these systems known to the Applicants involve complicated arrangements of springs, gears and transmission systems.

U.S. Pat. No. 6,283,192, to Toti discloses a spring drive system for window covers which includes a so-called flat spring drive and the combination whose elements are selected from a group which includes (1) a band transmission which provides varying ratio power transfer as the cover is opened and closed; (2) a gear system selected from various gear sets which provide frictional holding force and fixed power transfer ratios; and (3) a gear transmission which provides fixed ratio power transfer as the cover is opened or closed. The combination permits the spring drive force at the cover to be tailored to the weight and/or compression characteristics of the window cover such as a horizontal slat or pleated or box blind as the cover is opened and closed.

U.S. Pat. No. 6,536,503, to Anderson et al. discloses a modular blind transport system for a window blind application. The complete system purportedly may be assembled form a relatively small number of individual modules to obtain working systems for a very wide range of applications, including especially a category of counterbalanced blinds wherein a relatively small external input force may be used to raise or lower the blind, and/or to open or close the blind.

U.S. Pat. No. 6,648,050, to Toti shows a spring drive system useful for window covers which comprises one or more coil spring drives or flat spring drives and the combination whose elements are selected from one or more of a group which includes (1) a band or cord transmission which provides varying ratio power transfer as the cover is opened and closed; (2) gear means comprising various gear sets which provide frictional holding force and fixed power transfer ratios; (3) a gear transmission which provides fixed ratio power transfer as the cover is opened or closed; (4) crank mechanisms; (5) brake mechanisms; and (6) recoiler mechanisms. The combination of all these elements is said to permit the spring drive force to be tailored to the weight and/or compression characteristics of an associated window cover such as a horizontal slat or pleated or box blind as the cover is opened and closed.

U.S. Pat. No. 6,957,683 to Toti discloses a spring drive system said to be useful for window covers which comprises one or more coil spring drives or flat spring drives and the combination whose elements are selected from one or more of a group which includes (1) a band or cord transmission which provides varying ratio power transfer as the cover is opened and closed; (2) gear means comprising various gear sets which provide frictional holding force and fixed power transfer ratios; (3) a gear transmission which provides fixed ratio power transfer as the cover is opened or closed; (4) crank mechanisms; (5) brake mechanisms; and (6) recoiler mechanisms. The combination of all of these elements is said to permit the spring drive force to be tailored to the weight and/or compression characteristics of an associated window cover such as a horizontal slat or pleated or box blind as the cover is opened and closed.

U.S. Pat. No. 6,983,783 to Carmen et al. discloses a motorized shade control system that includes electronic drive units (EDUs) having programmable control units directing a motor to move an associated shade in response to command signals directed to the control units from wall-mounted keypad controllers or from alternate devices or control systems connected to a contact closure interface (CCI). Each of the EDUs, keypad controllers and CCIs of the system is connected to a common communication bus. The system provides for initiation of soft addressing of the system components from any keypad controller, CCI or EDU. The system also provides for setting of EDU limit positions and assignment of EDUs to keypad controllers from the keypad controllers or CCIs. The system may also include infrared receivers for receiving infrared command signals from an infrared transmitter.

U.S. Pat. No. 7,185,691 to Toti discloses a reversible pull cord mechanism adapted for rotating a shaft in one direction when the pull cord is pulled in a first direction and rotating the shaft in the opposite direction when the pull cord is pulled in a second direction.

In sum, each of the prior art systems attempts to overcome by brute electrical mechanical force the shade torque profile created by the weight of the hanging shade and connected elements of a particular shade system or to partially compensate for, to counterbalance, the weight by means of complicated spring, gear and transmission systems. Further, prior art spring counterbalance systems generally overcompensate to ensure complete retrieval of an extended shade and thus require weight to be added to the bottom bar of a shade to ensure the shade fully extends and to prevent the shade from retracting inadvertently. This extra weight wears on the system, causes batteries to drain more quickly and is an added expense. Importantly, none of the prior art systems known to Applicants enables a user to construct a counterbalance system that approximates the torque profile of any particular shade system without undue overcompensation and that is easy to add to and delete from as circumstances dictate.

Thus, there is a need in the art for a counterbalance for shade systems that is applicable to all sizes of shade systems that is capable of providing a counterbalance that matches or nearly matches the torque requirements of each particular shade system and that does not require intricate gears or transmissions.

It therefore is an object of this invention to provide a spring counterbalance for a shade system that includes the combination of at least two spring systems that create a counterbalance torque profile that matches or approximates the torque profile of a subject shade system. It is a further object of the invention to provide a spring counterbalance apparatus and method that is easy to assemble, install and maintain.

SUMMARY OF THE INVENTION

Accordingly, a spring counterbalance apparatus of the present invention, according to one embodiment, includes a shade system with a torque profile, where the shade system is connected with a drive shaft. A first spring system is connected with the drive shaft where the first spring system is a standard wound spring system. A second spring system is connected with the drive shaft where the second spring system is a reverse wound spring system and where, in combination, the first spring system and the second spring system produce a counterbalance torque profile approximately equal to the shade system torque profile.

All terms used herein are given their common meaning as known in the art. Thus, "shade system" as will be described more fully hereafter with reference to the figures, includes, inter alia and for example only, a shade or cover suspended by lift cords or the like. The lift cords are connected to suspension cord spools which are connected to a "drive shaft". Movement of the drive shaft rotates the suspension cord spools which winds the lift cords on or off, again for example only. The combined weight of the shade system elements, shade, lift cords, etc. determine a particular "shade system torque profile" for each particular shade system as will be described more fully below.

Likewise, "standard wound system" as used herein describes a spring that is wound in the common, standard, fashion where the spring system is applying a torque in the direction to counteract the torque on the drive shaft generated by the force being applied by the lift cords. To differentiate the standard wound system from the "reverse wound system", the standard wound system is wound from the top of a spring storage spool to the bottom of a spring drive spool (See FIG. 5B) and provides a positive counterclockwise torque, as illustrated herein and described more fully hereafter. In contrast, a "reverse wound system" as used herein describes a spring that is wound in reverse manner from the common, "standard wound", fashion, that applies torque on the drive shaft in the opposite direction of the torque applied by the standard wound system. To differentiate the reverse wound system from the standard wound system, the reverse wound system is wound from the bottom of a spring storage spool to the top of a spring drive spool (See FIG. 5A) and provides a positive clockwise torque as illustrated herein as illustrated herein and described more fully hereafter.

According to the present invention, the combination of a "standard wound system" and a "reverse wound system" results in a "counterbalance torque profile".

In one aspect, the drive shaft extends through a spool of the first spring system and a spool of the second spring system and in another aspect a spool of the first spring system and a spool of the second spring system rotate upon an axis in alignment with the drive.

According to one aspect of the invention, the first spring system includes a spring storage spool and a spring drive spool and a spring with a first end and a second end where the first end is connected with the spring storage spool and the second end is connected with the spring drive spool and where the spring drive spool is connected with the drive shaft and where the second spring system includes a spring storage spool and a spring drive spool and a spring with a first end and a second end where the first end is connected with the spring storage spool and the second end is connected with the spring drive spool and where the spring drive spool is connected with the drive shaft.

In another aspect, the springs have a width and the width is varied such that the counterbalance torque profile approximately equals the shade system torque profile.

In one aspect, the standard wound spring system includes springs selected from a group consisting of: constant gradient, negative gradient and positive gradient springs. In another aspect, the reverse wound spring system includes springs selected from a group consisting of: constant gradient, negative gradient and positive gradient springs.

In a further aspect, the counterbalance torque profile is higher than the shade system torque profile and the apparatus further includes a removable bottom bar weight connected with the shade system.

In one aspect, the invention includes a spring housing for the first spring system and the second spring system. In another aspect, the spring housing consists of an independent housing for each spring system.

In a further aspect, the first spring system and the second spring system are connected to the drive shaft toward the middle of the drive shaft and away from the ends of the drive shaft.

According to another embodiment of the invention, a spring counterbalance apparatus includes a shade system with a torque profile, the shade system being connected with a drive shaft. At least one first spring system is provided where the first spring system includes a spring storage spool and a spring drive spool and a standard wound spring with a first end and a second end where the first end is connected with the spring storage spool and the second end is connected with the spring drive spool and the spring drive spool is connected with the drive shaft and where the standard wound spring is selected from a group consisting of: constant gradient, negative gradient and positive gradient springs. At least one second spring system is provided where the second spring system includes a spring storage spool and a spring drive spool and a reverse wound spring with a first end and a second end where the first end is connected with the spring storage spool and the second end is connected with the spring drive spool and the spring drive spool is connected with the drive shaft and where the reverse wound spring is selected from a group consisting of: constant gradient, negative gradient and positive gradient springs and where in combination the at least one first spring system and the at least one second spring system produce a counterbalance torque profile approximately equal to the shade system torque profile.

In one aspect of this invention, the springs have a width and the width is varied such that the counterbalance torque profile approximately equals the shade system torque profile.

In another aspect, the counterbalance torque profile is higher than the shade system torque profile and the invention further includes a removable bottom bar weight connected with the shade system.

In a further aspect, a spring housing is provided for the first spring system and the second spring system. In another aspect, the spring housing consists of an independent housing for each spring system.

In another aspect, the first spring system and the second spring system are connected to the drive shaft toward the middle of the drive shaft and away from the ends of the drive shaft.

In one aspect, the springs are flat springs.

According to another embodiment, a spring counterbalance method consists of:

a. providing a shade system with a torque profile, the shade system connected with a drive shaft; a first spring system connected with the drive shaft where the first spring system is a standard wound spring system; and a second spring system connected with the drive shaft where the second spring system is a reverse wound spring system and where in combination the first spring system and the second spring system produce a counterbalance torque profile; and b. adjusting the first spring system and the second spring system such that the counterbalance torque profile approximately equals the shade system torque profile.

In another aspect, the first spring system includes a spring storage spool and a spring drive spool and a standard wound spring with a first end and a second end where the first end is connected with the spring storage spool and the second end is connected with the spring drive spool and the spring drive spool is connected with the drive shaft and where the second spring system includes a spring storage spool and a spring drive spool and a reverse wound spring with a first end and a second end where the first end is connected with the spring storage spool and the second end is connected with the spring drive spool and where the spring drive spool is connected with the drive shaft.

In one aspect, the standard wound spring is selected from a group consisting of: constant gradient, negative gradient and positive gradient springs and the reverse wound spring is selected from a group consisting of: constant gradient, negative gradient and positive gradient springs.

In another aspect, the springs have a width and the width is varied such that the counterbalance torque profile approximately equals the shade system torque profile. And in another aspect, the shade system includes a shade and the method further includes the step of grasping the shade and moving it up or down to a desired location such that the shade remains in place where moved.

DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE INVENTION

Figure 1:
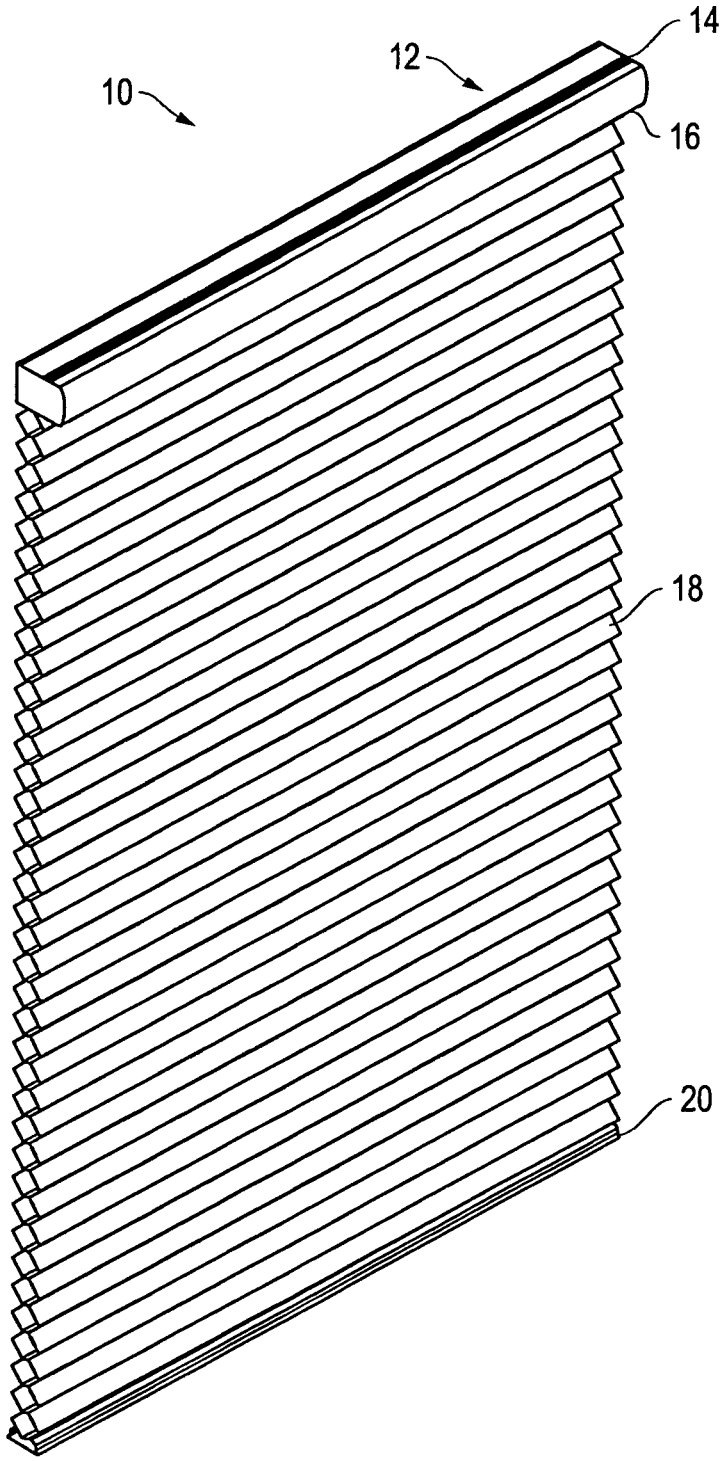
FIG. 1 is a perspective view of a Prior Art shade system with shade extended.

The preferred embodiment of the present invention is illustrated by way of example in FIGS. 1-8. With specific reference to FIGS. 1 and 2, spring counterbalance apparatus 10 is disclosed with reference to a shade system 12. Shade system 12 includes head rail 14 and head rail cover 16. Shade system 12 also includes architectural opening cover, shade 18. Shade system 12 typically includes a bottom bar 20 designed to make contact with a window sill, not shown, for example only, so as to ensure a uniform contact with the sill. Bottom bar 20 also adds weight to the unattached end of shade 18 as may be useful according to the present invention as will be described more fully hereafter. All these elements of the invention are known in the art and not described more fully hereafter except to note that the shade 18 may be any form, cellular as shown, slat, Venetian blind or the like.

Figure 2:
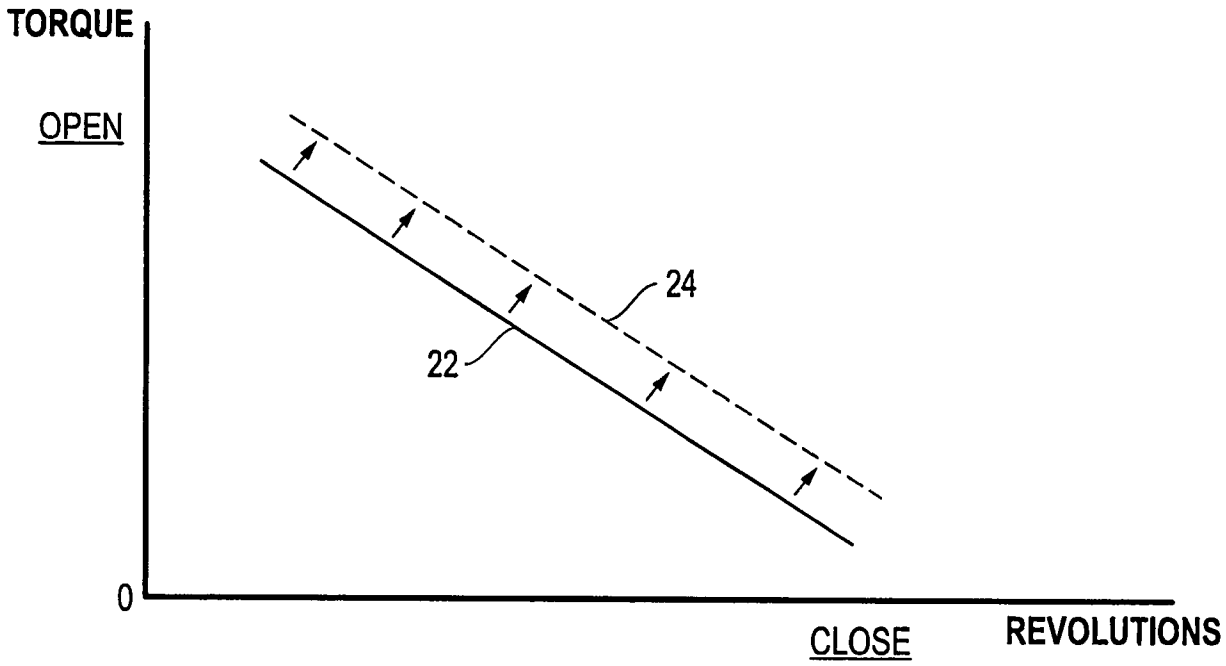
FIG. 2 is a graph illustrating the shade system torque profile of the shade system of FIG. 1 and a counterbalance torque profile.

FIG. 2 is a graph showing the shade system torque profile 22 for shade system 12. All the elements of the shade system 12 that contribute to the weight of the shade 18 that must be raised and lowered contribute to a shade system torque profile 22 that is unique for each shade system 12. Shade system torque profile 22 is a negative gradient profile with the highest torque requirements imposed when the shade is extended and reducing as revolutions increase and the shade 18 is raised.

FIG. 2 also illustrates a counterbalance torque profile 24 in dotted lines. Counterbalance torque profile 24, in this example, has been created, as will be more fully described hereafter, with a higher nominal torque than the shade system torque profile 22. It should be understood that the present invention enables a counterbalance torque profile 24 to be created that matches or nearly matches and is approximately equal to the shade system torque profile 22. However, according to one aspect of the invention, it is just as easily possible to create the slightly higher counterbalance torque profile 24 illustrated in FIG. 2 to extend the operating life of the system. That is, over time, due to material fatigue, stress relaxation, etc. in the springs, the torque generated from the counterbalance is reduced. If the counterbalance torque profile 24 is initially designed to exactly match the shade system torque profile 22, the counterbalance would lose the ability to provide sufficient torque to counteract the torque of the shade system 12. So, by creating a higher nominal counterbalance torque profile 24, a small amount of weight, such as bottom bar 20 or the like, may be added to the shade 18 to balance the torque profiles exactly. As the counterbalance begins to fatigue, a user can simply remove the added bottom bar 20 weight and thereby extend the useful life of the counterbalance system. It should be understood that the use of the spring counterbalance apparatus 10 in this manner is only an option that is available because the invention enables creation of specific desired counterbalance torque profiles 24 as more fully described hereafter.

Figure 3:
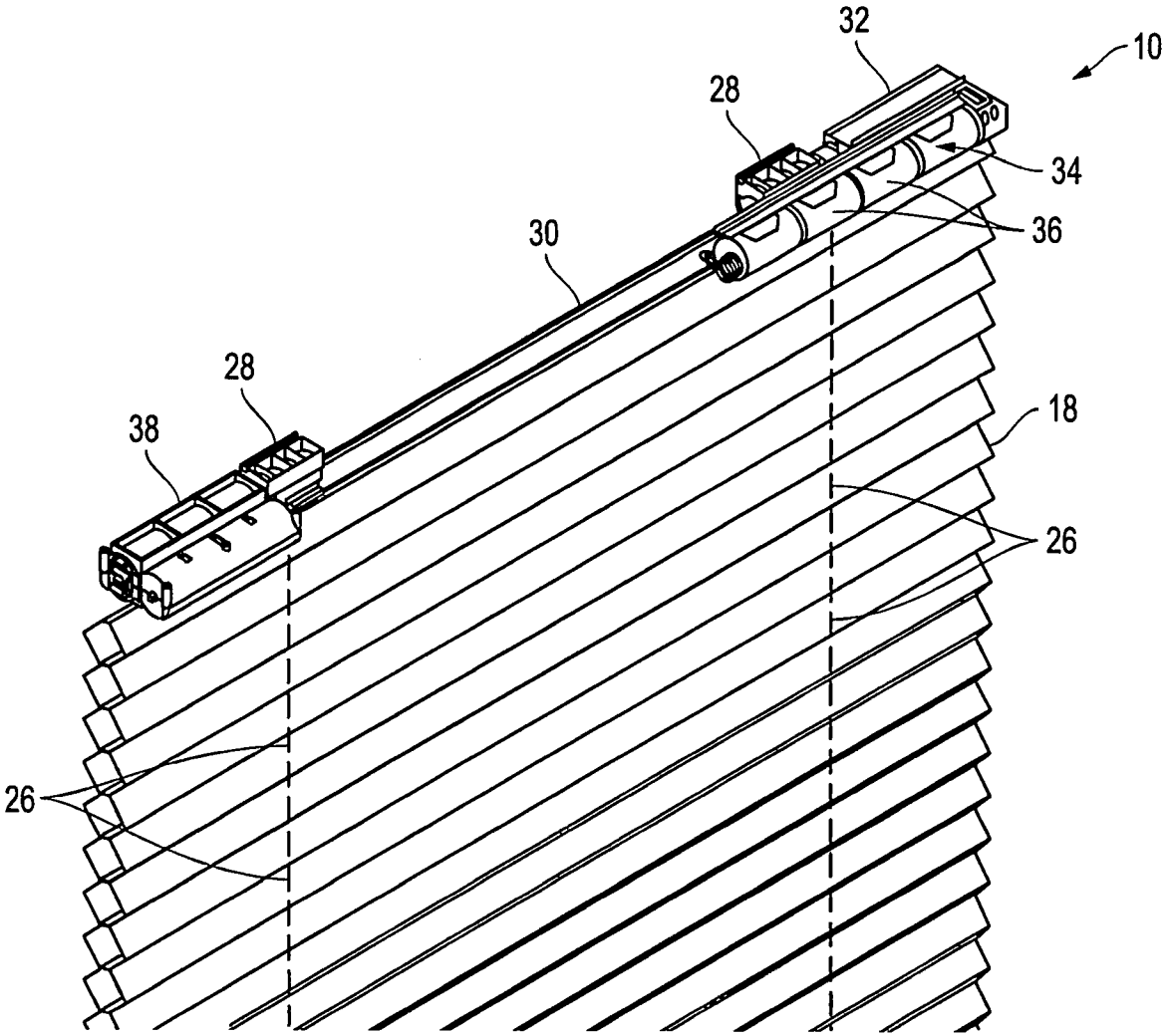
FIG. 3 is a perspective view of the spring counterbalance apparatus of the present invention connected with a shade system in a prior art location at the end of the drive shaft.
Figure 4:
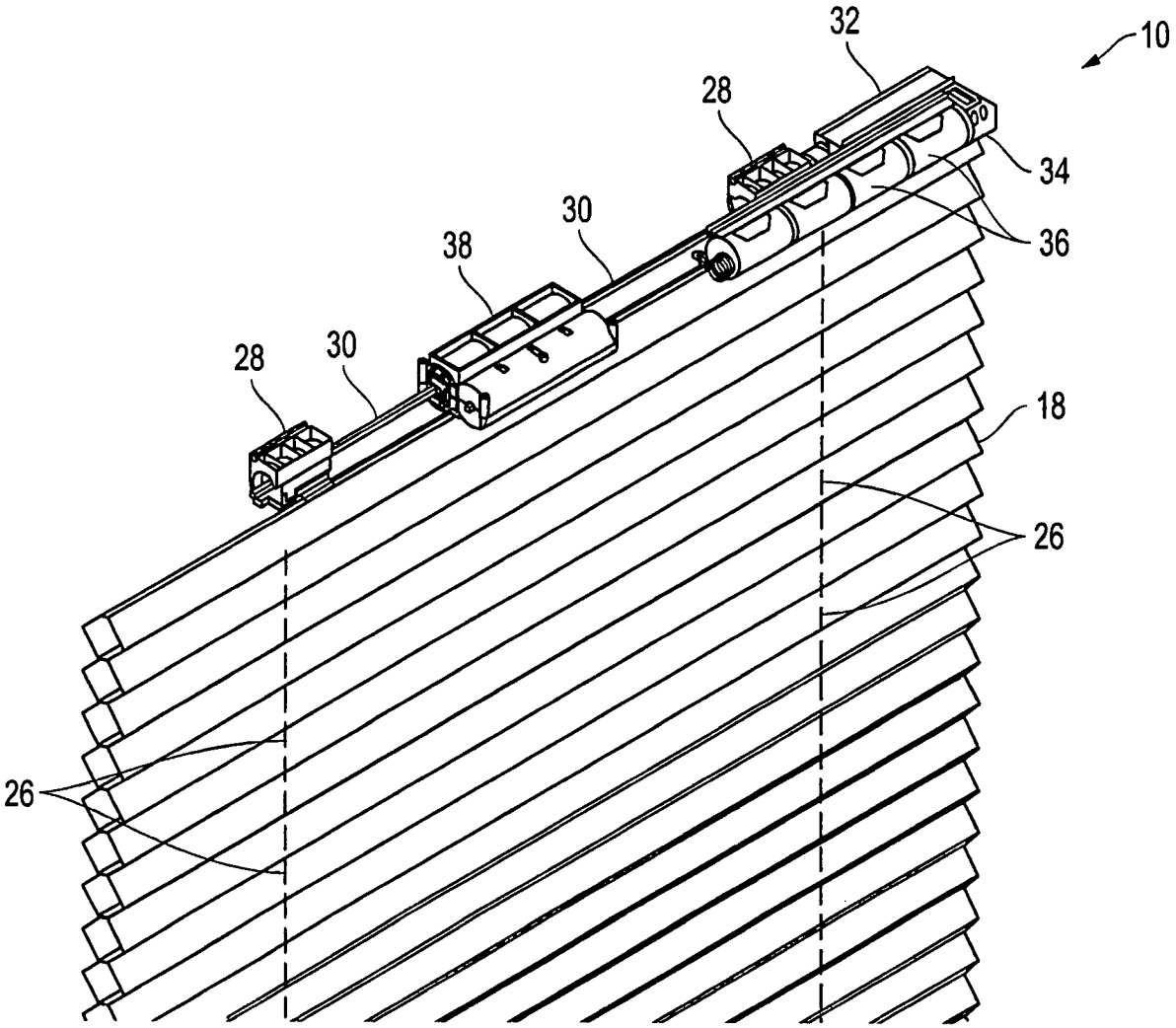
FIG. 4 is a perspective view of the invention of FIG. 3 showing the spring counterbalance apparatus located near the middle of the drive shaft away from the ends of the drive shaft.

Referring now to FIGS. 3 and 4, partial perspective views of the invention of FIG. 1 are shown with the head rail 14 and head rail cover 16 removed to show suspension cords 26 (in dotted lines). Suspension cords 26 are connected with shade 18 with one end (not shown) connected at the bottom of shade 18 as at bottom bar 20 and the other end connected with suspension cord housings 28. Suspension cord housings 28 are connected with drive shaft 30. Drive shaft 30 is connected with motor 32 and motor 32 is connected with power supply 34 as, for example only, batteries 36. Operation of the motor 32 moves drive shaft 30 in one direction or the other such that suspension cord housings 28 move and either wind suspension cords 26 onto or off of suspension cord housings 28. Without a counterbalance, motor 32 and power supply 34 must be sufficient alone to effect the movement of the shade 18.

FIG. 3 illustrates a spring counterbalance 38 connected as with all prior art systems known to the Applicants at one end of the drive shaft 30. While the system may function in this location, according to one aspect of the invention, spring counterbalance 38 is preferably located at the middle area of drive shaft 30 away from the ends of the drive shaft 30 as shown in FIG. 3. This location, Applicants have determined greatly reduces torsion on the drive shaft 30, helps suspend it and reduces wear, tear and noise due to operation.

Figure 5A:
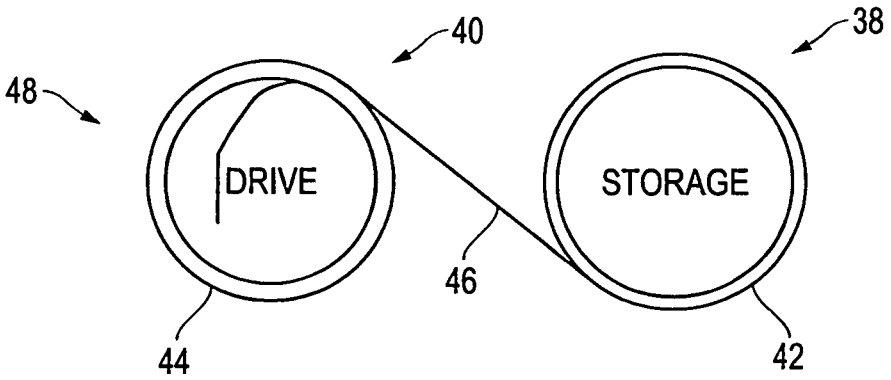
FIG. 5A illustrates a reverse wound spring system according to the invention and FIG. 5B illustrates a standard wound spring system according to the present invention.
Figure 5B:
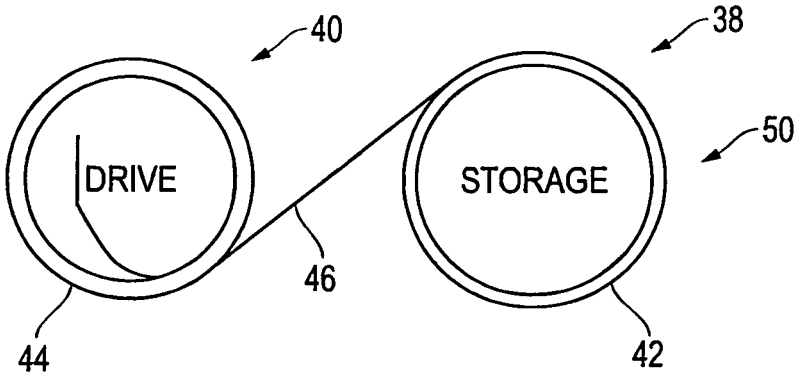

Referring now to FIGS. 5A and 5B, spring counterbalance 38 is shown to be composed of a combination of spring systems 40. Spring system 40 includes a spring storage spool 42 and a spring drive spool 44 and a spring 46. One end of spring 46, preferably a flat spring, is connected with spring storage spool 42 and the other end of spring 46 is connected with spring drive spool 42. Importantly, FIG. 5A shows a reverse wound spring system 48 in which spring 46 is connected with the top of spring drive spool 44 and the bottom of spring storage spool 42. Conversely, FIG. 5B shows a standard wound spring system 50 in which spring 46 is connected with the bottom of spring drive spool 44 and the top of spring storage spool 42. If the standard wound spring system 50 and the reverse wound spring system 48 are constant torque springs, for example only, they would cancel each other out and have no effect on the shade system torque profile 22. However, by mixing various spring systems 40, reverse wound 48 and standard wound 50, Applicants have enabled a user to create a limitless range of counterbalance torque profiles 24.

Figure 6:
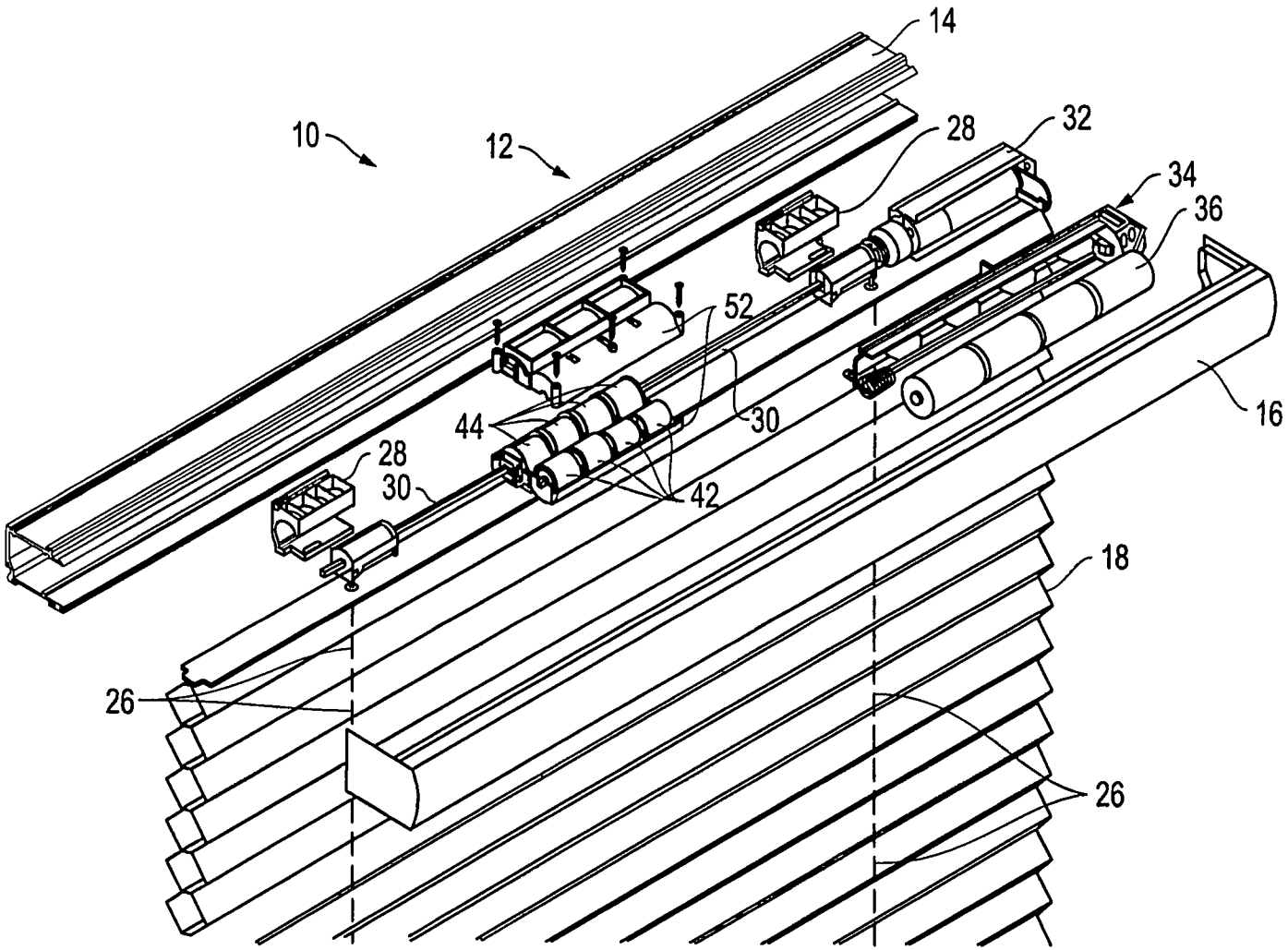
FIG. 6 is an exploded view of the invention according to FIG. 4.
Figure 7:
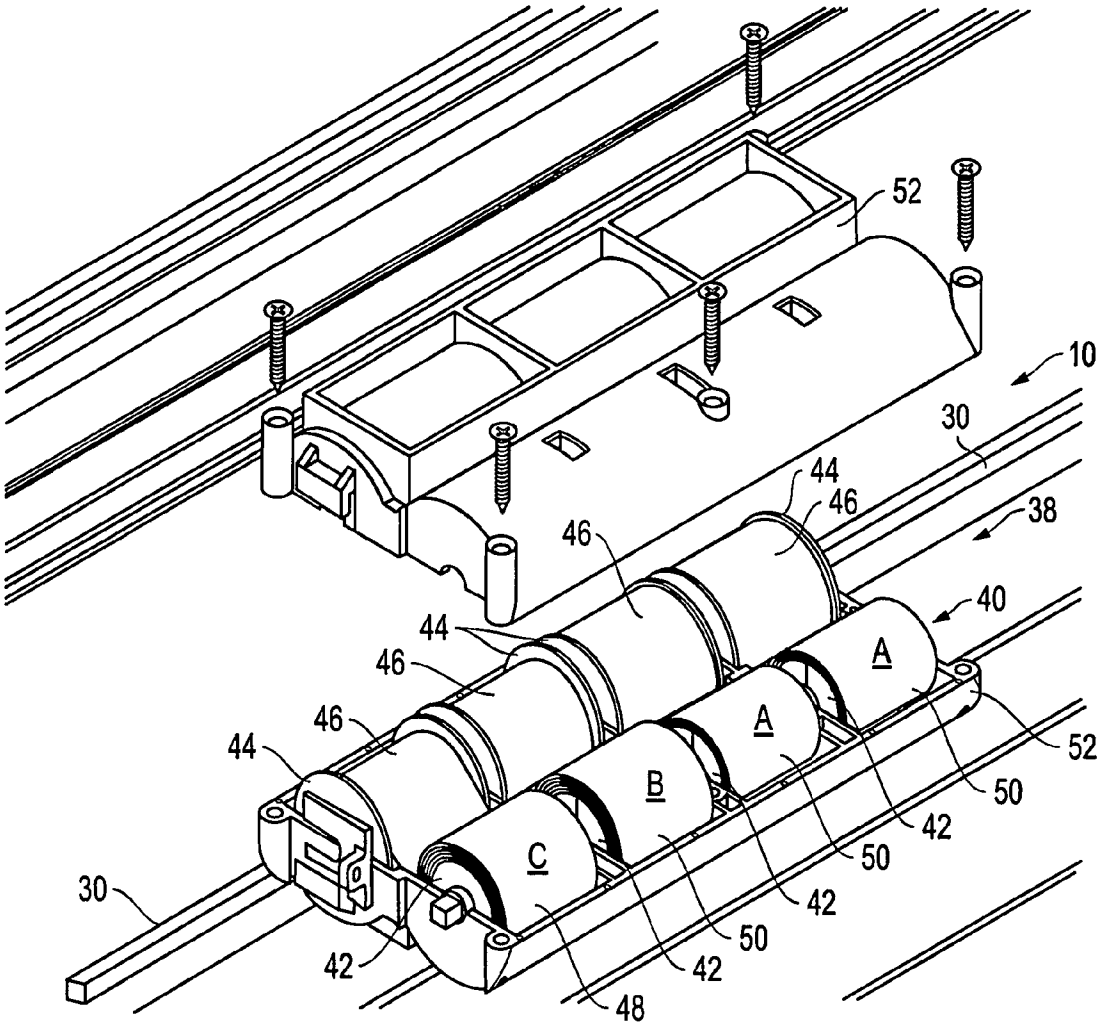
FIG. 7 is a close up exploded view of the invention of FIG. 6.

Referring now to FIGS. 6 and 7, spring counterbalance 38 spring system 40, consisting of multiple spring storage spools 42 and spring drive spools 44, is shown in spring housing 52. Importantly, spring drive spools 44 are connected with drive shaft 30. Spring housing 52 may be a single housing encompassing all the spring systems 40 as more clearly shown in FIG. 7. It also may be that spring housing 52 encloses each individual spring system 40 or that more than one spring housing 52 is provided.

Figure 8:
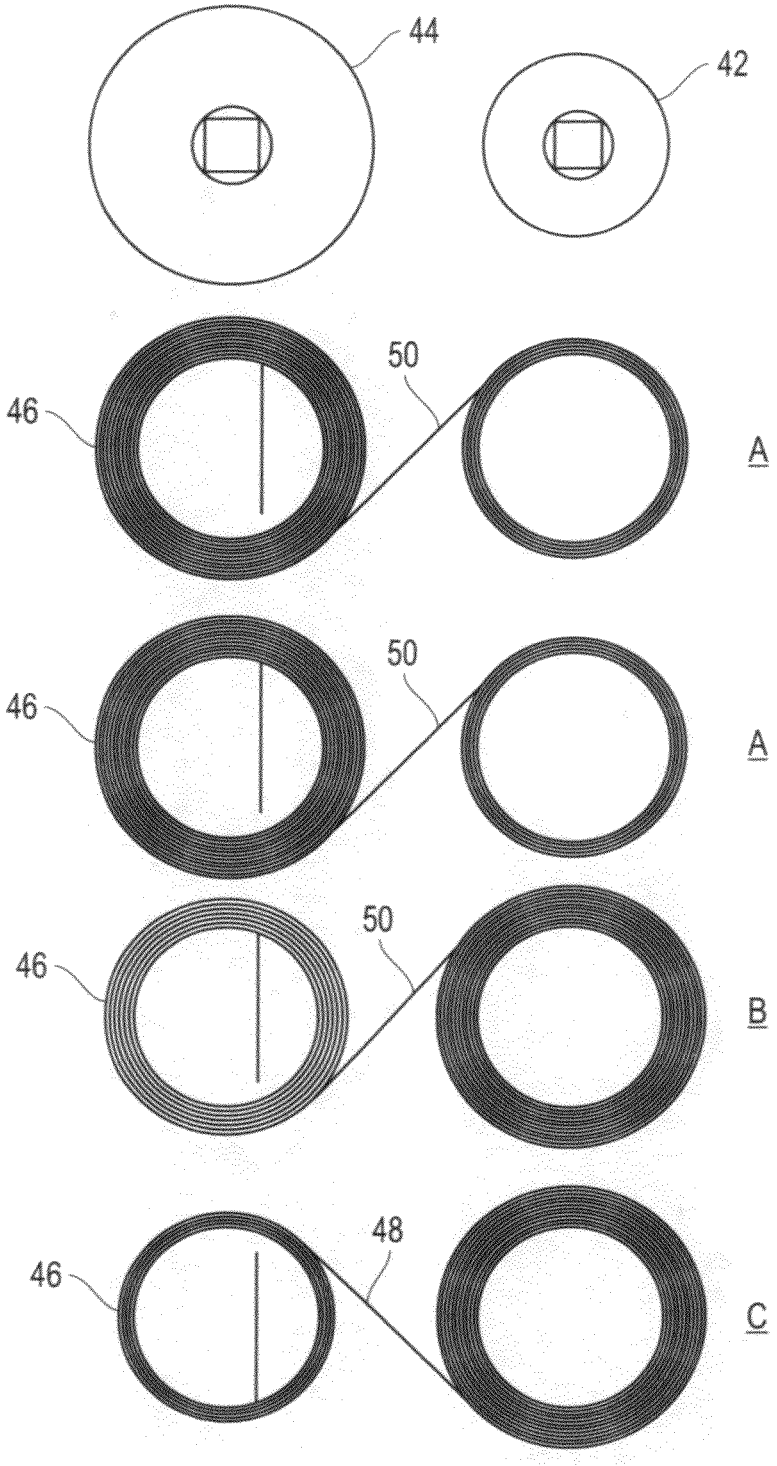
FIG. 8 is a schematic showing the combination of standard wound and reverse wound spring systems of the invention of FIG. 7.

FIGS. 7 and 8 illustrate a spring counterbalance 38 made up of multiple spring systems 40 that create a desired counterbalance torque profile. As illustrated, for example only and not by way of limitation, this particular spring counterbalance 38 includes two negative gradient standard wound spring systems 50 labeled "A"; one preloaded negative gradient standard wound spring system 50 labeled "B"; and one negative gradient reverse wound spring system 48 labeled "C". The result is a spring counterbalance apparatus 10 that matches or nearly matches the torque exerted on the drive shaft 30 by suspension cords 26, bottom bar 20, etc. such that the combined torque will approach zero.

The Applicants have found that the present invention is extraordinarily flexible in particular when a full variety of torque gradient springs are accessed. That is, not only negative gradient springs are used. Also used or available are constant gradient and positive gradient springs. Thus, the invention includes standard wound spring systems 50 utilizing negative, positive and constant gradient springs and reverse wound spring systems 48 also utilizing negative, positive and constant gradient springs. Still further, Applicants have found that the width of the springs 46 provides another measure of flexibility. Making the springs 46 wider or narrower, it has been determined, also affects the torque profile.

As indicated above with regard to FIGS. 7 and 8, Applicants have determined that the use of "preloaded springs" also enhances the ability of the apparatus to match required shade system torque forces. The term "preloaded" as used herein is understood by noting that the force generated by any spring is a function of displacement. In the case of coiled flat springs (power/clock springs and constant torque springs for example), depending on length and spring drive spool/arbor diameter, there is a maximum number of revolutions, or displacement, that the coiled flat spring can provide as it is being wound onto the spring drive spool/arbor. In any case, as long as the spring is wound onto the spring drive spool/arbor less than the maximum allowable displacement, the spring will provide a torque (in the case for a window covering where a spring drive spool/arbor is connected to a drive shaft for example). The nominal amount of torque available is a direct function of the displacement of the spring on the spring drive spool/arbor. For example, a positive gradient spring will provide a torque that increases with displacement, a negative gradient spring will provide a torque that decreases with displacement, and a constant gradient spring will provide a torque that remains constant, or mostly constant, with displacement. For clarification, again, a standard wound system provides a counterclockwise, or positive, torque, and a reverse wound system provides a clockwise, or negative, torque. Also, the term "output drum" will be used in place of spring drive spool/arbor.

With a basic understanding of a coiled flat spring from the explanation above, the following three springs are used for example to further describe the term pre-loading:

1. Constant Gradient Spring
   a. Max Displacement: 42 Revolutions
   b. Torque Range: 3 in-oz. @ 2 Revolutions-3 in-oz. @ 42 Revolutions
2. Negative Gradient Spring
   a. Max Displacement: 42 Revolutions
   b. Torque Range: 7 in-oz. @ 2 Revolutions-3 in-oz. @ 42 Revolutions
3. Positive Gradient Spring
   a. Max Displacement: 42 Revolutions
   b. Torque Range: 3 in-oz. @ 2 Revolutions-7 in-oz. @ 42 Revolutions A spring's nominal range of torque values is dependent on material, width, thickness, natural spring radius, and output drum diameter. The present invention recognizes that any variation in these parameters can be used to create an ideal counterbalance system.

By way of example, along with these three springs being considered, it is assumed that a window covering requires the drive shaft to rotate twenty revolutions in order to fully operate. The function of "pre-loading" is to shift the range of torque values used by each spring. Since the window covering only requires twenty revolutions, the first twenty revolutions of a spring, the last twenty revolutions of a spring, or any range of twenty revolutions in between may be pre-loaded. For example, if the following ranges of twenty revolutions for a standard wound system are considered:

a. 2-22 Revolutions
b. 12-32 Revolutions
c. 22-42 Revolutions

It is found that the three springs provide the following torque ranges:

1. Constant Gradient Spring
   a. Torque Range: 3 in-oz. @ 2 Revolutions-3 in-oz. @ 22 Revolutions
   b. Torque Range: 3 in-oz. @ 12 Revolutions-3 in-oz. @ 32 Revolutions
   c. Torque Range: 3 in-oz. @ 22 Revolutions-3 in-oz. @ 42 Revolutions
2. Negative Gradient Spring
   a. Torque Range: 7 in-oz. @ 2 Revolutions-5 in-oz. @ 22 Revolutions
   b. Torque Range: 6 in-oz. @ 12 Revolutions-4 in-oz. @ 32 Revolutions
   c. Torque Range: 5 in-oz. @ 22 Revolutions-3 in-oz. @ 42 Revolutions
3. Positive Gradient Spring
   a. Torque Range: 3 in-oz. @ 2 Revolutions-5 in-oz. @ 22 Revolutions
   b. Torque Range: 4 in-oz. @ 12 Revolutions-6 in-oz. @ 32 Revolutions
   c. Torque Range: 5 in-oz. @ 22 Revolutions-7 in-oz. @ 42 Revolutions Note, the previous torque ranges are for a standard wound system. A reverse wound system would provide the identical negative nominal torque ranges.

Thus, several of the same type, or gradient, of spring with the same "preload" may be used and/or several of different types, or gradient, of spring where each spring has a different preload, and/or any variation in between to create the ideal counterbalance system. Moreover, when this same "preload" concept is used in conjunction with the present invention where at least one standard wound system is combined with at least one reverse wound system, the range of achievable torque gradients and nominal ranges, without the addition of excessive bottom bar weight, to create the ideal counterbalance system is virtually limitless.

Another important aspect of the invention is that positioning of the shade 18 may be done by hand, manually. Applicants have observed that the motorized prior art systems can not be grasped by hand and moved to a desired location without having to disconnect motors, gears, etc. or when moved will not stay in the new location The spring counterbalance apparatus and method 10 of the present invention has the unique advantage of enabling simple hand location without changing, altering or removing elements of the system. It is an advantageous result of the structure of the invention that the combined spring systems 40 assist movement when moved and, yet, resist movement when stopped and which, therefore, stay in place after movement either mechanically by the motor 32 or manually.

In summary, a user determines the shade system torque profile 22 and then matches it with a counterbalance torque profile 24 created from a combination of at least one standard wound spring system 50 and at least one reverse wound spring system 48 assembled from negative, positive or constant gradient springs of the same or different widths and possibly some prewound, preloaded, springs as well.

The description of the present embodiments of the invention has been presented for purposes of illustration, but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the invention as defined by the following claims.

What is claimed is:

1. A spring counterbalance apparatus comprising:

a shade system with a torque profile, the shade system having-a drive shaft;

a first spring system connected with the drive shaft wherein the first spring system is a standard wound spring system having a spring storage spool and a spring drive spool;

a second spring system connected with the drive shaft wherein the second spring system is a reverse wound spring system having a spring storage spool and a spring drive spool;

wherein in combination the first spring system and the second spring system produce a counterbalance torque profile approximately equal to the shade system torque profile;

wherein an axis of rotation of the spring drive spool of the first spring system and an axis of rotation of the spring drive spool of the second spring system are aligned; and wherein an axis of rotation of the spring storage spool of the first spring system and an axis of rotation of the spring storage spool of the second spring system are aligned.

2. The apparatus of claim 1 wherein the drive shaft extends through a spool of the first spring system and a spool of the second spring system.

3. The apparatus of claim 1 wherein a spool of the first spring system and a spool of the second spring system rotate upon an axis in alignment with the drive shaft.

4. The apparatus of claim 1 wherein the first spring system includes a spring with a first end and a second end wherein the first end is connected with the spring storage spool and the second end is connected with the spring drive spool and wherein the spring drive spool is connected with the drive shaft and wherein the second spring system includes a spring with a first end and a second end wherein the first end is connected with the spring storage spool and the second end is connected with the spring drive spool and wherein the spring drive spool is connected with the drive shaft.

5. The apparatus of claim 1 wherein a spring of the standard wound spring system and a spring of the reverse wound spring system have a width and the width is varied such that the counterbalance torque profile approximately equals the shade system torque profile.

6. The apparatus of claim 1 wherein the standard wound spring system includes one or more springs selected from a group consisting of: constant gradient, negative gradient and positive gradient springs.

7. The apparatus of claim 1 wherein the reverse wound spring system includes one or more springs selected from a group consisting of: constant gradient, negative gradient and positive gradient springs.

8. The apparatus of claim 1 wherein the counterbalance torque profile is higher than the shade system torque profile and further including a removable bottom bar weight connected with the shade system.

9. The apparatus of claim 1 wherein the first spring system and the second spring system are connected to the drive shaft toward the middle of the drive shaft and away from the ends of the drive shaft.

10. The apparatus of claim 1 further comprising a motor connected to the drive shaft such that operation of the motor causes rotation of the drive shaft, the first spring system and the second spring system.

11. A spring counterbalance apparatus comprising:

a shade system with a torque profile, the shade system having a drive shaft;

a first spring system wherein the first spring system includes a spring storage spool and a spring drive spool and a standard wound spring with a first end and a second end wherein the first end is connected with the spring storage spool and the second end is connected with the spring drive spool and the spring drive spool is connected with the drive shaft and wherein the standard wound spring is selected from a group consisting of: constant gradient, negative gradient and positive gradient springs;

a second spring system wherein the second spring system includes a spring storage spool and a spring drive spool and a reverse wound spring with a first end and a second end wherein the first end is connected with the spring storage spool and the second end is connected with the spring drive spool and the spring drive spool is connected with the drive shaft and wherein the reverse wound spring is selected from a group consisting of: constant gradient, negative gradient and positive gradient springs;

wherein an axis of rotation of the spring drive spool of the first spring system and an axis of rotation of the spring drive spool of the second spring system are aligned;

wherein an axis of rotation of the spring storage spool of the first spring system and an axis of rotation of the spring storage spool of the second spring system are aligned; and wherein in combination the first spring system and the second spring system produce a counterbalance torque profile approximately equal to the shade system torque profile.

12. The apparatus of claim 11 wherein the standard wound springs and the reverse wound springs are preloaded springs.

13. The apparatus of claim 11 wherein the counterbalance torque profile is higher than the shade system torque profile and further including a removable bottom bar weight connected with the shade system.

14. The apparatus of claim 11 further including a spring housing for the first spring system and the second spring system.

15. The apparatus of claim 11 wherein the spring housing includes an independent housing for the first spring system and the second spring system.

16. The apparatus of claim 11 wherein the first spring system and the second spring system are connected to the drive shaft toward the middle of the drive shaft and away from the ends of the drive shaft.

17. The apparatus of claim 11 wherein the springs of the first spring system and the second spring system are flat springs.

18. The apparatus of claim 11 further comprising a motor connected to the drive shaft such that operation of the motor causes rotation of the drive shaft, the first spring system and the second spring system.

19. The apparatus of claim 11 wherein the drive shaft extends through a spool of the first spring system and a spool of the second spring system.

20. The apparatus of claim 11 wherein the shade system is movable between an open position and a closed position by manual movement and by motorized movement.

21. A spring counterbalance method comprising:

providing a shade system with a torque profile, the shade system having a drive shaft;

a first spring system connected with the drive shaft wherein the first spring system is a standard wound spring system having a spring storage spool and a spring drive spool;

a second spring system connected with the drive shaft wherein the second spring system is a reverse wound spring system having a spring storage spool and a spring drive spool;

wherein in combination the first spring system and the second spring system produce a counterbalance torque profile;

wherein an axis of rotation of the spring drive spool of the first spring system and an axis of rotation of the spring drive spool of the second spring system are aligned; and wherein an axis of rotation of the spring storage spool of the first spring system and an axis of rotation of the spring storage spool of the second spring system are aligned;

adjusting the first spring system and the second spring system such that the counterbalance torque profile approximately equals the shade system torque profile.

22. The method of claim 21 wherein the first spring system includes a standard wound spring with a first end and a second end wherein the first end is connected with the spring storage spool and the second end is connected with the spring drive spool and the spring drive spool is connected with the drive shaft and wherein the second spring system includes a reverse wound spring with a first end and a second end wherein the first end is connected with the spring storage spool and the second end is connected with the spring drive spool and wherein the spring drive spool is connected with the drive shaft.

23. The method of claim 21 wherein the standard wound spring is selected from a group consisting of: constant gradient, negative gradient and positive gradient springs and wherein the reverse wound spring is selected from a group consisting of: constant gradient, negative gradient and positive gradient springs.

24. The method of claim 21 wherein the shade system includes a shade and further comprising the step of grasping the shade and moving it up or down to a desired location such that the shade remains in the place where moved.

25. The apparatus of claim 21 further comprising a motor connected to the drive shaft such that operation of the motor causes rotation of the drive shaft, the first spring system and the second spring system.

* * * * *